US011066764B2

(12) United States Patent
Alletto, Jr.

(10) Patent No.: US 11,066,764 B2
(45) Date of Patent: Jul. 20, 2021

(54) COOLING FABRIC

(71) Applicant: BEDGEAR, LLC, Farmingdale, NY (US)

(72) Inventor: Eugene Alletto, Jr., Glen Head, NY (US)

(73) Assignee: BEDGEAR, LLC, Farmingdale, NY (US)

( * ) Notice: Subject to any disclaimer, the term of this patent is extended or adjusted under 35 U.S.C. 154(b) by 296 days.

(21) Appl. No.: 16/033,988

(22) Filed: Jul. 12, 2018

(65) Prior Publication Data

US 2019/0017200 A1 Jan. 17, 2019

Related U.S. Application Data

(60) Provisional application No. 62/532,540, filed on Jul. 14, 2017.

(51) Int. Cl.
*D04B 21/06* (2006.01)
*A47G 9/02* (2006.01)
(Continued)

(52) U.S. Cl.
CPC ..... *D04B 21/06* (2013.01); *A47C 21/046* (2013.01); *A47C 31/006* (2013.01); *A47G 9/02* (2013.01); *D02G 3/36* (2013.01); *D02G 3/40* (2013.01); *D04B 1/123* (2013.01); *A47C 27/002* (2013.01); *A47G 9/0238* (2013.01); *D10B 2321/0211* (2013.01); *D10B 2331/04* (2013.01); *D10B 2401/02* (2013.01); *D10B 2403/023* (2013.01); *D10B 2503/06* (2013.01)

(58) Field of Classification Search
CPC ... D04B 1/16; D04B 1/22; D04B 7/30; D04B 7/28; D04B 9/42
See application file for complete search history.

(56) References Cited

U.S. PATENT DOCUMENTS 3,403,203 A 9/1968 Schirmer
3,449,058 A 6/1969 David et al.
(Continued)

FOREIGN PATENT DOCUMENTS

EP 2042629 A1 4/2009
GB 1148086 A 4/1969
(Continued)

OTHER PUBLICATIONS

PCT/US2018/041845 International Search Report and Written Opinion of the International Searching Authority—dated Nov. 7, 2018 European Patent Office.
(Continued)

*Primary Examiner* — Danny Worrell
(74) *Attorney, Agent, or Firm* — Sorell, Lenna & Schmidt, LLP

(57) ABSTRACT

A three-layer circular knitted jacquard fabric includes a first layer having a yarn made from a first material. A second layer of the fabric includes a yarn made from a second material. A third layer of the fabric includes a yarn made from a third material. At least one of the materials includes ultra-high weight molecular polyethylene. The second layer is positioned between the first layer and the third layer such that the second layer provides loft between the first layer and the third layer.

24 Claims, 5 Drawing Sheets

(51) Int. Cl.

| | |
|---|---|
| ***D04B 1/12*** | (2006.01) |
| ***A47C 21/04*** | (2006.01) |
| ***A47C 31/00*** | (2006.01) |
| ***D02G 3/36*** | (2006.01) |
| ***D02G 3/40*** | (2006.01) |
| *A47C 27/00* | (2006.01) |

(56) References Cited

U.S. PATENT DOCUMENTS

| | | | | |
|---|---|---|---|---|
| 5,350,625 | A | 9/1994 | Peterson et al. | |
| 6,145,348 | A * | 11/2000 | Hardegree | D04B 27/06 28/158 |
| 6,783,853 | B2 | 8/2004 | Figuly et al. | |
| 7,484,256 | B2 | 2/2009 | Murphy et al. | |
| 7,565,821 | B2 * | 7/2009 | Park | B60N 2/976 66/195 |
| 7,752,681 | B2 | 7/2010 | Michel | |
| 7,849,715 | B2 * | 12/2010 | Starbuck | A41C 5/00 66/171 |
| 9,357,863 | B1 | 6/2016 | Goenka | |
| 9,551,095 | B2 * | 1/2017 | Lee | D04B 15/367 |
| 2004/0168479 | A1 * | 9/2004 | McMurray | D04B 21/16 66/202 |
| 2004/0186405 | A1 | 9/2004 | Pinna et al. | |
| 2005/0245164 | A1 | 11/2005 | Aneja et al. | |
| 2006/0160451 | A1 | 7/2006 | Dry et al. | |
| 2006/0272100 | A1 | 12/2006 | Barberis | |
| 2007/0107662 | A1 | 5/2007 | Queen et al. | |
| 2007/0251276 | A1 | 11/2007 | D'ottaviano et al. | |
| 2008/0254263 | A1 | 10/2008 | Yasui et al. | |
| 2010/0261397 | A1 | 10/2010 | Sabourin et al. | |
| 2011/0212658 | A1 | 9/2011 | Vandeplancke et al. | |
| 2012/0255128 | A1 | 10/2012 | Sytz | |
| 2013/0017747 | A1 | 1/2013 | Giloh et al. | |
| 2014/0068868 | A1 | 3/2014 | Morzano et al. | |
| 2017/0020230 | A1 * | 1/2017 | Dombrow | A43B 23/02 |

FOREIGN PATENT DOCUMENTS

| | | | |
|---|---|---|---|
| WO | 2015188956 | A1 | 11/2015 |
| WO | 2015188956 | A1 | 12/2015 |
| WO | 2016182870 | A1 | 11/2016 |

OTHER PUBLICATIONS

International Application No. PCT/US2018/041845 Pub. No. WO/2019/014461 WIPO—World Intellectual Property Written Opinion of the International Searching Authority, International Search Report dated Jan. 17, 2019.

* cited by examiner

COOLING FABRIC

TECHNICAL FIELD

The present disclosure generally relates to cooling fabrics, and more particularly to three-layer circular knitted jacquard fabrics made from different yarns to provide cooling to the body of a user, or a portion thereof, resting on the fabrics. Articles of bedding made from such fabrics and methods of use are included.

BACKGROUND

Sleep is critical for people to feel and perform their best, in every aspect of their lives. Sleep is an essential path to better health and reaching personal goals. Indeed, sleep affects everything from the ability to commit new information to memory to weight gain. It is therefore essential for people to use bedding that is personalized to fit both their individual sleep preference and body type, in order to achieve comfortable, restful sleep.

Selecting the appropriate type of bedding is an important aspect in achieving proper sleep. For example, selecting a pillow, mattress, mattress cover, mattress topper, etc. that feels cool as it absorbs heat from the user's body can greatly affect how comfortable the user is when they sleep. The cool feel of such bedding may be controlled by selecting bedding made from a fabric or other material that provides a desired level of coolness. Cooling fabrics or materials may be formed of materials, such as, for example, various foams or gels. However, conventional cooling fabrics used in bedding are known to feel coarse or otherwise uncomfortable to the touch, which can prevent restful sleep. This disclosure describes an improvement over these prior art technologies.

SUMMARY

In one embodiment, in accordance with the principles of the present disclosure, a three-layer circular knitted jacquard fabric is provided that includes a first layer having a yarn made from a first material. A second layer of the fabric includes a yarn made from a second material. A third layer of the fabric includes a yarn made from a third material. At least one of the materials includes ultra-high weight molecular polyethylene. The second layer is positioned between the first layer and the third layer such that the second layer provides loft between the first layer and the third layer. In some embodiments, the layers can be made with the same materials. For example, the second layer may be made from a material, such as, for example, a polyester material and the third layer can also be made from the same material as the second layer. In some embodiments, a top layer, such as, for example, the first layer can be coated with a phase change material and a bottom layer, such as, for example, the third layer can be coated with a phase change material. It is envisioned that the first layer and/or the third layer can be soaked with a phase change material and/or can be infused with a phase change material.

In one embodiment, in accordance with the principles of the present disclosure, the first material comprises ultra-high weight molecular polyethylene and the second and third materials comprise polyester fiber. The second material is typically a "fill" fiber that, in order to create loft and cushioning effect, is thicker than the polyester fiber of the third material, which is thinner to allow for a tighter weave, such that the thicker fiber will not penetrate through to the bottom side. In one embodiment, in accordance with the principles of the present disclosure, the first layer and the third layer form a substrate that surrounds the second layer, with all three layers then calculated by total volume as comprising between about 10% and about 50% ultra-high weight molecular polyethylene and between about 50% and 90% polyester; with the second material being included in this calculation and 100% polyester. In one embodiment, in accordance with the principles of the present disclosure, each material forms a layer; the first layer and the third layer form a substrate that surrounds the second layer, with all three layers then calculated by total volume as comprising 33% ultra-high weight molecular polyethylene and 67% polyester; with the second material being included in this calculation and 100% polyester.

In one embodiment, in accordance with the principles of the present disclosure, the first material comprises ultra-high weight molecular polyethylene; the second material comprises polyester fiber combined with moisture-wicking polyester fiber, which is an alternative to standard polyester fiber, created with enhanced properties for this purpose, or treated to ensure this function, and the third material comprises polyester. In one embodiment, in accordance with the principles of the present disclosure, each material forms a layer; the first layer and the third layer form a substrate that surrounds the second layer, with all three layers then calculated by total volume as comprising between about 10% and about 50% ultra-high weight molecular polyethylene and between about 50% and 90% polyester; with the second material being included in this calculation and comprising between about 1% and about 20% moisture-wicking polyester and between about 80% and about 99% standard polyester. In one embodiment, in accordance with the principles of the present disclosure, the first layer and the third layer form a substrate that surrounds the second layer, with all three layers then calculated by total volume as comprising 33% ultra-high weight molecular polyethylene and 67% polyester; with the second material being included in this calculation and comprising 7% moisture-wicking polyester and 93% polyester. In some embodiments, the moisture-wicking polyester fiber combines round cross section polyester with cross or star shaped cross section moisture-wicking polyester, which has ditches, tunnels and/or grooves that speed up moisture transport and diffusion.

In one embodiment, in accordance with the principles of the present disclosure, the first material comprises ultra-high weight molecular polyethylene; the second material comprises polyester and viscose, and this viscose includes phase-change material, which employs an alternative to standard viscose yarn, created with enhanced properties for this purpose, or treated to ensure this function; and the third material comprises polyester. In some embodiments, the viscose fiber comprises pores on it and the phase change material is embedded onto the viscose fiber using a melt-spun process when extruding the yarn. In some embodiments, the second material is polyester. It is envisioned that the viscose fiber can be soaked with a phase change material and/or can be infused with a phase change material. In some embodiments, the second material is polyester that is embedded with a phase change material. It is envisioned that second material can be soaked with a phase change material and/or can be infused with a phase change material. In one embodiment, in accordance with the principles of the present disclosure, the phase change material may be derived from petroleum or salt hydrates, or replacement equivalents of these products, that serves the function to freeze and unfreeze at a designated temperature(s) and thus absorb heat and/or release cooling to create a cooling effect. In one embodiment, in accordance with the principles of the present disclosure, each material forms a layer; the first layer and the third layer form a substrate that surrounds the second layer. In one embodiment, in accordance with the principles of the present disclosure, the second layer is made from polyester and viscose, and the phase change material is embedded within the viscose yarn. It is envisioned that the second layer can be soaked with a phase change material and/or can be infused with a phase change material. In one embodiment, in accordance with the principles of the present disclosure, the second layer is made from polyester and viscose, and the yarn of the viscose is coated with the phase change material. In one embodiment, in accordance with the principles of the present disclosure, the first layer and the third layer form a substrate that surrounds the second layer, with all three layers then calculated by total volume as comprising between about 10% and about 50% ultra-high weight molecular polyethylene and between about 38% and 68% polyester and between about 12% and 22% viscose, inclusive of phase change material; with the second material included in this calculation and comprising between about 10% and 90% polyester and between about 10% and 90% viscose, by the volume calculation for this layer. In one embodiment, in accordance with the principles of the present disclosure, the first layer and the third layer form a substrate that surrounds the second layer, the substrate comprising 33% ultra-high weight molecular polyethylene and 50% polyester and 17% viscose; with the second material included in this calculation and comprising 50% polyester and 50% viscose, inclusive of phase change material, by the volume calculation for this layer.

In one embodiment, in accordance with the principles of the present disclosure, the first material comprises ultra-high weight molecular polyethylene and a phase change material; the second material comprises polyester, viscose and a second phase change material; and the third layer comprises polyester, which may be the same as the second material or different. In some embodiments, the phase change material is coated onto a surface of the ultra-high weight molecular polyethylene. In one embodiment, in accordance with the principles of the present disclosure, the viscose is a yarn that has the second phase change material embedded within the viscose yarn. In some embodiments, the phase change material is embedded with the viscose and/or the polyester. In one embodiment, in accordance with the principles of the present disclosure, the viscose is a yarn that is coated with the second phase change material. In one embodiment, in accordance with the principles of the present disclosure, the phase change material may be comprised of petroleum or salt hydrates, or replacement equivalents of these products, that serves the function to freeze and unfreeze at a designated temperature(s) and thus absorb heat and/or release cooling to create a cooling effect. In one embodiment, in accordance with the principles of the present disclosure, the second phase change material comprises may be derived from petroleum or salt hydrates, or replacement equivalents of these products. In one embodiment, in accordance with the principles of the present disclosure, the yarn of the first layer is made from the ultra-high weight molecular polyethylene and the phase change material is embedded within the yarn of the first layer. In one embodiment, in accordance with the principles of the present disclosure, the yarn of the first layer is made from the ultra-high weight molecular polyethylene and the yarn of the first layer is coated with the phase change material. In one embodiment, in accordance with the principles of the present disclosure, the first layer and the third layer form a substrate that surrounds the second layer, the substrate comprising between about 20% and about 40% ultra-high weight molecular polyethylene, between about 40% and about 60% of the phase change material and between about 10% and 20% polyester; and the second material comprises between about 40% and about 60% of the viscose and the second phase change material and between about 40% and about 60% polyester. In one embodiment, in accordance with the principles of the present disclosure, the first layer and the third layer form a substrate that surrounds the second layer, the substrate comprising 33% ultra-high weight molecular polyethylene, 50% of the phase change material and 17% polyester; and the second material comprises 50% of the viscose and the second phase change material and 50% polyester. The percentages are calculated based on total volume.

In one embodiment, in accordance with the principles of the present disclosure, the first material comprises ultra-high weight molecular polyethylene; the second material comprises polyester, moisture wicking polyester, and viscose with a phase change material, and the third layer comprises polyester. It is envisioned that the viscose can be soaked with a phase change material and/or can be infused with a phase change material. In some embodiments, the moisture wicking polyester is a high-performance functional polyester fiber. Its cross section differs from regular polyester fiber. The moisture wicking polyester fiber is "cross" shaped with multiple ditches around it. The ditches formed by the specific cross section create channels and when placed next to each other, which speeds up the moisture transport and diffusion process. The wicking channels within the fiber and between fiber yarns quickly move sweat to the surface of the fabric where it is evaporated. Such cross section also creates a large surface area which picks up moisture and carries it away from the body, spreading it out, to evaporate easily on the outside of the fabric through capillary action over a wider surface area. Moisture wicking polyester fiber can also be combined with a moisture wicking finish on fabric surface or a unique fabric construction in order to achieve balanced temperature regulation to prevent overheating. In one embodiment, in accordance with the principles of the present disclosure, the viscose is a yarn that has the second phase change material embedded within the viscose yarn. It is envisioned that the viscose can be soaked with a phase change material and/or can be infused with a phase change material. In one embodiment, in accordance with the principles of the present disclosure, the viscose is a yarn that is coated with the second phase change material. In one embodiment, in accordance with the principles of the present disclosure, the yarn of the first layer is made from the ultra-high weight molecular polyethylene and the phase change material is embedded within the yarn of the first layer. It is envisioned that the first layer can be soaked with a phase change material and/or can be infused with a phase change material. In one embodiment, in accordance with the principles of the present disclosure, the yarn of the first layer is made from the ultra-high weight molecular polyethylene and the yarn of the first layer is coated with the phase change material. In one embodiment, in accordance with the principles of the present disclosure, the first layer and the third layer form a substrate that surrounds the second layer, with all three layers then calculated by total volume as comprising between about 10% and about 50% ultra-high weight molecular polyethylene, and between about 38% and 68% polyester, including moisture-wicking polyester; and between about 12% and 22% viscose, inclusive of phase change material; with the second material included in this calculation and comprising between about 10% and 90% polyester and between about 10% and 90% viscose, by the volume calculation for this layer. The second material comprises between about 40% and about 60% of the viscose and phase change material, between about 1 and about 15% of the moisture wicking polyester, and between about 35% and about 50% polyester. In one embodiment, in accordance with the principles of the present disclosure, the first layer and the third layer form a substrate that surrounds the second layer, with all three layers then calculated by total volume as comprising 33% ultra-high weight molecular polyethylene, and 50% polyester, including moisture-wicking polyester, and 17% viscose inclusive of the phase change material; with the second material included in this calculation and comprising of 50% of the viscose with phase change material, 7% of the moisture-wicking polyester, and 43% standard polyester, by the volume calculation for this layer.

In the embodiments discussed herein wherein the fabric includes ultra-high weight molecular polyethylene and a filler material, such as moisture-wicking polyester and/or a viscose fiber with phase change material, the phase change material is used to provide a long-lasting cooling effect. Once heat is transferred from the user's body to the fabric, molecules of the phase change material meet the ultra-high weight molecular polyethylene, which acts as a heat source. This heat exchange between the user's body and the molecules of the phase change material causes a core of the phase change material to change from a solid to a liquid to create a cooling sensation. When the heat source is removed, such as, for example, by removing the user's body from the fabric, the core of the phase change material releases stored latent heat and solidifies. This resets the molecule's cooling capacity. As such, the phase change material acts as a storing mechanism for body heat, thereby facilitating the ultra-high weight molecular polyethylene for continuous heat exchange. In some embodiments, the phase change material provides for absorption of surplus body heat, provides an insulation effect caused by heat emission of the phase change material into the fabric, and provides a thermo-regulating effect that keeps the micro climate temperature nearly constant. It is envisioned that any of the layers and/or yarns can be soaked with a phase change material and/or can be infused with a phase change material.

In one embodiment, in accordance with the principles of the present disclosure, an article of bedding is provided that includes first and second panels, inner surfaces of the panels defining a cavity; and a fill material disposed in the cavity, wherein at least one of the panels is made from one or more of the fabrics discussed herein. In one embodiment, in accordance with the principles of the present disclosure, the article of bedding is selected from the group consisting of mattress toppers, mattresses, pillows, sheets, and blankets. In one embodiment, in accordance with the principles of the present disclosure, the article of bedding includes a gusset positioned between the first panel and the second panel such that the first panel is spaced apart from the second panel by the gusset.

BRIEF DESCRIPTION OF THE DRAWINGS

The present disclosure will become more readily apparent from the specific description accompanied by the following drawings, in which.

DETAILED DESCRIPTION

Figure 1:
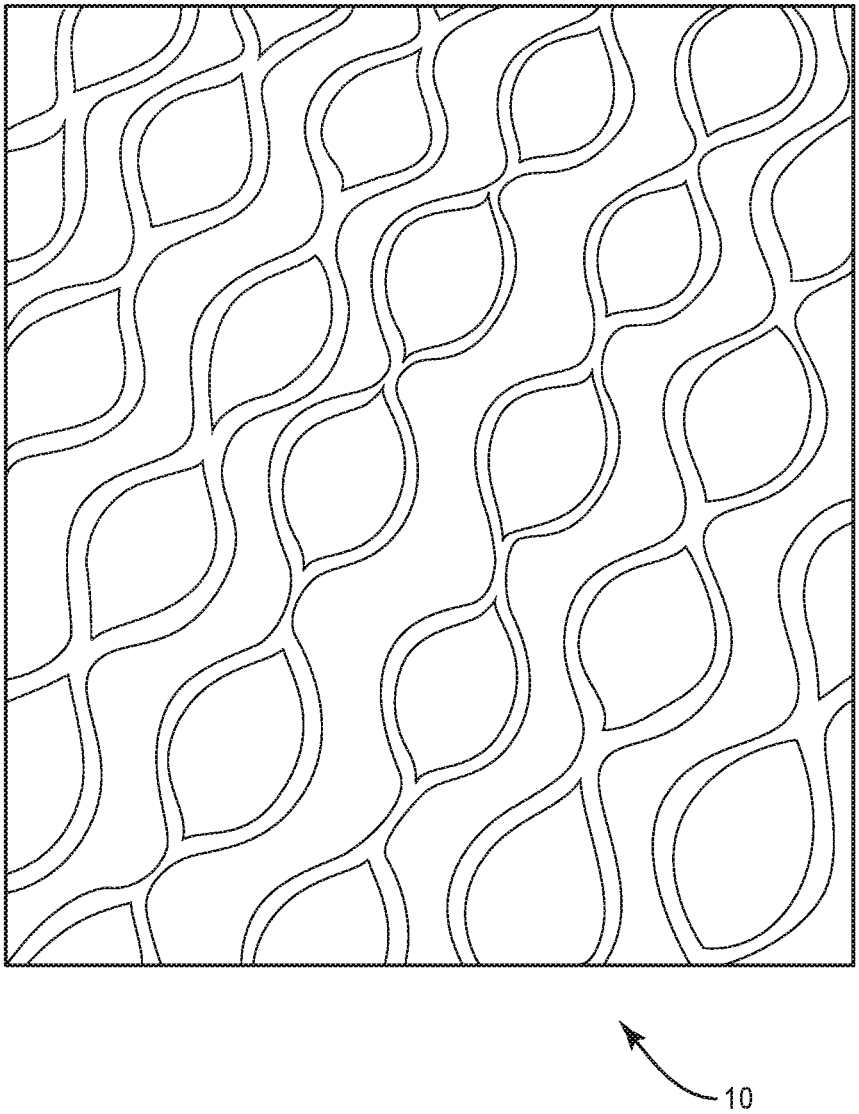
FIG. 1 is a top view of one embodiment of a fabric in accordance with the present principles of the present disclosure.

The exemplary embodiments of fabrics are discussed in terms of three-layer circular knitted jacquard fabrics that provide a cooling effect when used in bedding, such as, for example, pillows, mattresses, mattress covers, mattress toppers, blankets, etc. The present disclosure may be understood more readily by reference to the following detailed description of the disclosure. It is to be understood that this disclosure is not limited to the specific devices, methods, conditions or parameters described and/or shown herein, and that the terminology used herein is for the purpose of describing particular embodiments by way of example only and is not intended to be limiting of the claimed disclosure.

Also, as used in the specification and including the appended claims, the singular forms "a," "an," and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about," it will be understood that the particular value forms another embodiment. It is also understood that all spatial references, such as, for example, horizontal, vertical, top, upper, lower, bottom, left and right, are for illustrative purposes only and can be varied within the scope of the disclosure. For example, the references "upper" and "lower" are relative and used only in the context to the other, and are not necessarily "superior" and "inferior".

The following discussion includes a description of three-layer circular knitted jacquard fabric 10 that provides a cooling effect when used in bedding. Alternate embodiments are also disclosed. Reference will now be made in detail to the exemplary embodiments of the present disclosure.

The components of fabric 10 can be fabricated from materials including polymers and/or composites, depending on the particular application. For example, fabric 10 can be fabricated from materials such as fabrics or textiles, yarns, fibers, paper or cardboard, cellulosic-based materials, biodegradable materials, plastics and other polymers, semi-rigid and rigid materials. Fabric 10 may also be fabricated from a heterogeneous material such as a combination of two or more of the above-described materials. Fabric 10 and/or components thereof can be knitted, woven, extruded, molded, injection molded, cast, pressed and/or machined.

Fabric 10 is a three-layer circular knitted jacquard fabric, as discussed herein. In some embodiments, the circular knitting process includes circularly knitting yarn or other material into a fabric, such as, for example, fabric 10. Circular knitting may include organizing knitting needles into a circular knitting bed. The knitting needles produce a circular fabric that is in a tubular form through the center of the cylinder. The circular fabric is then cut to produce fabric 10 such that fabric 10 has a square or rectangular shape. This allows fabric 10 to be formed from a single, continuous piece of performance fabric that is produced using circular knitting. As such, fabric 10 may extend from a first side surface to a second side surface without including any seams between the first side surface and the second side surface. Fabric 10 may also extend from an upper surface to a bottom surface without including any seams between the upper surface and the bottom surface.

In some embodiments, fabric 10 undergoes finishing processes, such as, for example, dyeing, setting and/or rolling (packing) after the circular knitting process described herein. In some embodiments, fabric 10 undergoes finishing processes, such as, for example, dyeing, setting and/or rolling (packing) before the circular knitting process described herein. In some embodiments, fabric 10 undergoes finishing processes, such as, for example, dyeing, setting and/or rolling (packing) during the circular knitting process described herein. In some embodiments, fabric 10 undergoes a finishing process at yarn stage as well when fabric 10 is dyed, for example. In some embodiments, the heat setting is done at about 120° C. at about 10 yards/minute. In some embodiments, fabric 10 is washed before, during or after the circular knitting process described herein. In some embodiments, fabric 10 is washed at a pH level of about 2.0 to about 9.0. In some embodiments, the washing at a pH level of about 2.0 to about 9.0 is a pre-treatment wherein pH levels are acidic or faintly acidic for health and to be comfortable to the skin. In some embodiments, fabric 10 is washed at a pH level of about 4.0 to about 7.0. In some embodiments, fabric 10 is treated with a mixing agent before, during or after the circular knitting process described herein. In some embodiments, the mixing agent is a smoothing agent. In some embodiments, the mixing agent comprises dimethyl terephthalate, ethylene glycol and/or polyethylene glycol. In some embodiments, the mixing agent is applied at an amount between about 1% to about 10%. In some embodiments, the mixing agent is applied at an amount between about 4% to about 6%. In some embodiments, the mixing agent is applied at an amount of about 5%. In some embodiments, the mixing agent is applied at an amount greater than about 10%.

As used herein, ultra-high weight molecular polyethylene includes a material that are a subset of the thermoplastic polyethylene. Ultra-high weight molecular polyethylene may also be referred to as high-modulus polyethylene or high-performance polyethylene. Ultra-high weight molecular polyethylene has extremely long chains. Ultra-high weight molecular polyethylene is a type of polyolefin having a melting point of about 130° C. to about 136° C. (266° F. to 277° F.). Ultra-high weight molecular polyethylene has very high thermal conductivity properties that feel cool to the touch. Ultra-high weight molecular polyethylene provides thermal conduction while transferring heat away from a user's body. Heat flows from source to sink, such as, for example, from a warmer or hotter body to a cooler or colder body. When used in bedding, the hotter body is the human body and the colder body is a fabric the bedding is made from, the fabric comprising ultra-high weight molecular polyethylene. Ultra-high weight molecular polyethylene has a very high rate of thermal conduction, which creates a temperature differential/gradient between the human body and a surface of the fabric, thus allowing heat to diffuse from the human body to the fabric. Over time temperature differences decay and a thermal equilibrium is achieved to help the user achieve a restful sleep with long lasting cooling.

As used herein, polyester includes a polyester fiber that is derived from terephthalic acid. Polyester is man-made fine, regular and translucent filament or staple fiber. It is formed into a fiber by extruding the heated polymer through a spinneret. This results in the fiber taking the cross-section of the spinneret. Regular polyester fiber differs from moisture wicking polyester based on the cross section of the fiber. The cross section of a regular polyester is circular, rod like appearance with a uniform diameter while moisture wicking polyester fiber cross section has ditches/grooves e.g. star shape.

As used herein, moisture wicking polyester is a functional polyester fiber with a special cross section where polymer is extruded with ditches around the four edges, which speeds up the moisture absorption and diffusion. The ditches provide spaces between the polymers that create channels for fast moisture wicking. As compared to regular polyester, nylon and cotton, the cross section of moisture wicking polyester provides higher vertical moisture wicking and diffusion. Moisture wicking polyester may include yarns having 50, 75, 100, 150 and 200 deniers.

As used herein, viscose includes semi-synthetic fibers that are obtained by treating cellulose with a caustic alkali solution and carbon sulfide. It is used in manufacturing regenerated cellulose fibers, sheets, or tubes, such as, for example, rayon or cellophane.

As used herein, phase change material include reactive microencapsulated materials that possess the ability to change their physical state (phase) from "solid to liquid" and from "liquid to solid", within a certain temperature range, in response to ambient temperature differences. Phase change materials absorb heat when the temperature goes up, stores this energy temporarily, and releases the energy as heat when the temperature cools down.

Figure 2:
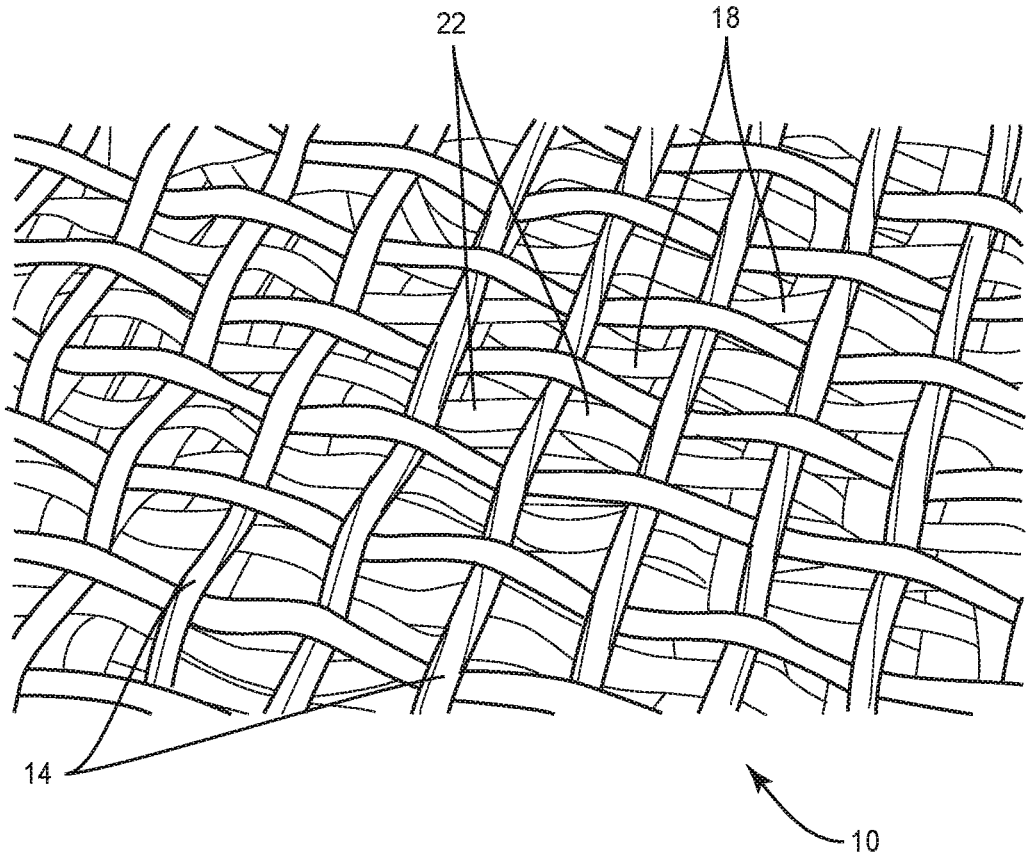
FIG. 2 is a detailed, close up view of the fabric shown in FIG. 1.
Figure 3:
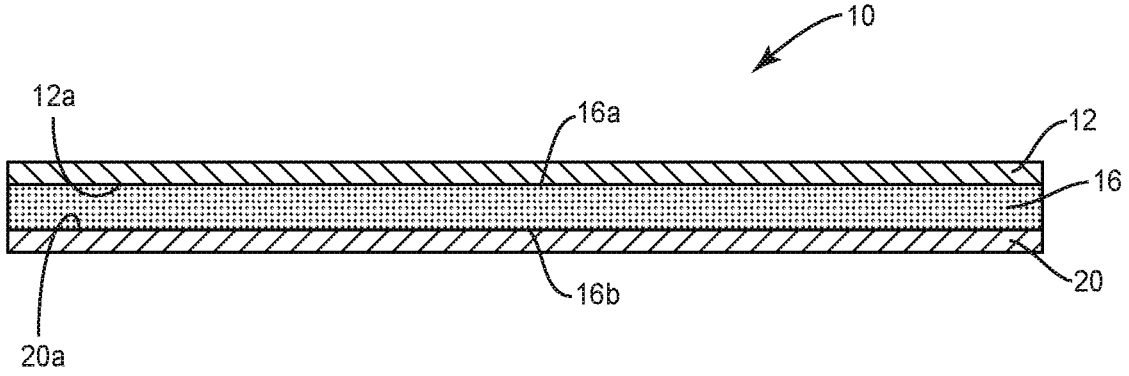
FIG. 3 is a schematic, cross sectional view of the fabric shown in FIG. 1.

In one embodiment, shown in FIGS. 1-3, fabric 10 includes a layer 12 comprising yarns 14 made from a first material, a layer 16 comprising yarns 18 made from a second material, and a layer 20 comprising yarns 22 made from a third material. At least one of the first, second and third materials comprises ultra-high weight molecular polyethylene. Layer 16 is positioned between layer 12 and layer 20 such that layer 16 provides loft of float between layer 12 and layer 20. In some embodiments, layer 16 includes thick yarns with a high thread count, such as, for example, 600 D, 900 D, 1200 D, 1500 D, 2400 D or higher. Such thicknesses of the yarns help to create loft. Layer 16 also provides loft or float because the yarns that layer 16 is made from do not get knitted by needles to form a pattern. Instead, the yarns are fed between layers 12 and 14 and are held by layers 12 and 14. In some embodiments, layer 16 is knitted and/or woven with layer 12 and layer 20 such that yarns 18 are woven with yarns 14 and yarns 22, as shown in FIG. 2. In some embodiments, layer 16 is positioned between layer 12 and layer 20 such that an outer surface 16*a* of layer 16 engages an inner surface 12*a* of layer 12 and an outer surface 16*b* of layer 16 engages an inner surface 20*a* of layer 20, as shown in FIG. 3. Surface yarns (e.g., yarns that make up layer 12) stay in their place and bottom yarns (e.g., yarns that make up layer 14) come to layer 12 and back again to form surface patterns and leave stitches behind in form of a pattern. Filler yarns (e.g., yarns that make up layer 16) are simply fed between the layers 12, 14 as the bottom yarns go back and forth to create a pattern on top to hold the two layers together. This bottom yarn patterning process helps filler yarns to stay intact. In some embodiments, filler yarns are pulled to the surface as well to form part of a pattern. In some embodiments, surface yarns do not go to the bottom.

In one embodiment, in accordance with the principles of the present disclosure, the first material comprises ultra-high weight molecular polyethylene and the second and third materials comprise polyester. In one embodiment, in accordance with the principles of the present disclosure, layer 12 and layer 20 form a substrate that surrounds layer 16, the substrate comprising between about 10% and about 50% ultra-high weight molecular polyethylene and between about 50% and 90% polyester; and the second material is 100% polyester. In one embodiment, in accordance with the principles of the present disclosure, layer 12 and layer 20 form a substrate that surrounds layer 16, the substrate comprising 33% ultra-high weight molecular polyethylene and 67% polyester; and the second material is 100% polyester.

In one embodiment, in accordance with the principles of the present disclosure, the first material comprises ultra-high weight molecular polyethylene; the second material comprises polyester and moisture wicking polyester; and layer 20 comprises polyester. In one embodiment, in accordance with the principles of the present disclosure, layer 12 and layer 20 form a substrate that surrounds layer 16, the substrate comprising between about 10% and about 50% ultra-high weight molecular polyethylene and between about 50% and 90% polyester; and the second material comprises between about 1% and about 20% moisture wicking polyester and between about 80% and about 99% polyester. In one embodiment, in accordance with the principles of the present disclosure, layer 12 and layer 20 form a substrate that surrounds layer 16, the substrate comprising 33% ultra-high weight molecular polyethylene and 67% polyester; and the second material comprises 7% moisture wicking polyester and 93% polyester.

Figure 4:
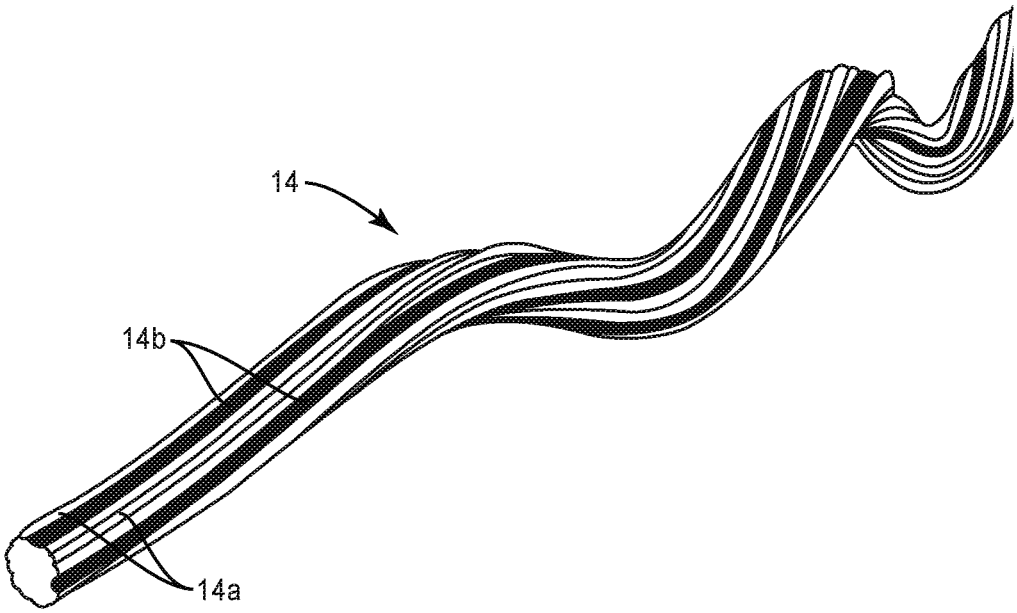
FIG. 4 is a perspective view of one embodiment of a yarn used in the fabric shown in FIG. 1.
Figure 5:
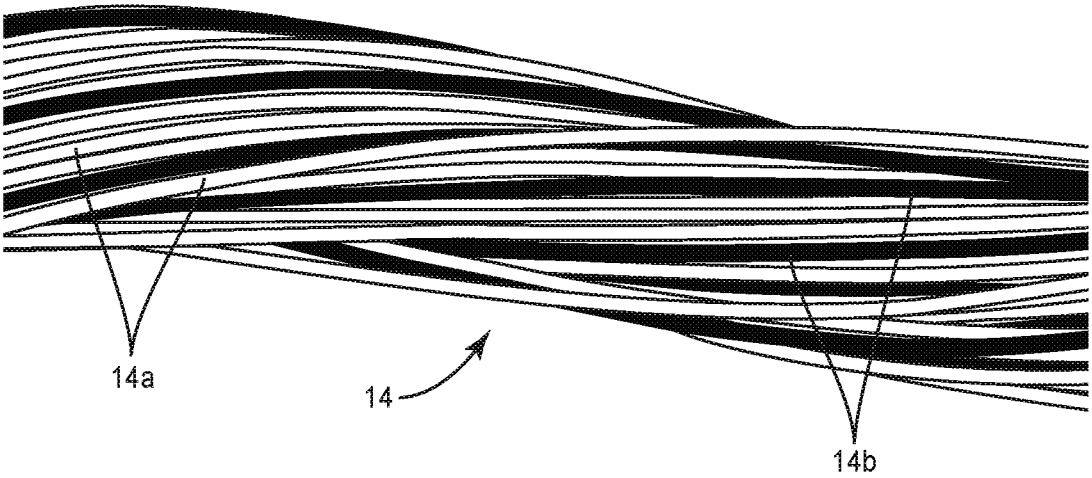
FIG. 5 is a detailed, close up view of the yarn shown in FIG. 4.

In one embodiment, in accordance with the principles of the present disclosure, the first material comprises ultra-high weight molecular polyethylene and a phase change material; the second material comprises polyester; and layer 20 comprises polyester. In one embodiment, in accordance with the principles of the present disclosure, the phase change material comprises a phase change polymer. It is envisioned that the ultra-high weight molecular polyethylene can be soaked with a phase change material and/or can be infused with a phase change material. In some embodiments, the phase change material may be derived from petroleum or salt hydrates, or replacement equivalents of these products, that serve the function to freeze and unfreeze at a designated temperature(s) and thus absorb heat and/or release cooling to create a cooling effect. In one embodiment, in accordance with the principles of the present disclosure, yarn 14 of layer 12 is made from the ultra-high weight molecular polyethylene and the phase change material is embedded within yarn 14 of layer 12. As shown in in FIGS. 4 and 5, the phase change material may include a plurality of fibers that are embedded within fibers of ultra-high weight molecular polyethylene to form yarn 14. In some embodiments, the fibers of the phase change material and the fibers of ultra-high weight molecular polyethylene may be twisted and/or helically wound with one another to form yarn 14 such that the fibers of the phase change material and the fibers of ultra-high weight molecular polyethylene form an outer surface of yarn 14. In one embodiment, in accordance with the principles of the present disclosure, yarn 14 of layer 12 is made from the ultra-high weight molecular polyethylene and yarn 14 of layer 12 is coated with the phase change material. In some embodiments, the coating that includes the phase change material also includes a connector, such as, for example, a glue or other adhesive. The adhesive is mixed with the phase change material and helps the phase change material to adhere to a surface of the fabric. In some embodiments, the phase change material is applied to the fabric using a printing method, such as, for example, screen printing or rotary printing. In some embodiments, the coating that includes the phase change material completely coats yarn 14. In some embodiments, the coating that includes the phase change material coats only a portion of yarn 14 that defines inner surface 12*a* of layer 12. In some embodiments, the phase change material includes microcapsules that are permanently fixed within yarn 14 by, for example, incorporating the microcapsules into the wet spinning procedure for polymer manufacturing. In some embodiments, yarn 14 includes hollow fibers with the phase change material inside the hollow fibers. It is envisioned that yarn 14 can be soaked with a phase change material and/or can be infused with a phase change material. In one embodiment, in accordance with the principles of the present disclosure, layer 12 and layer 20 form a substrate that surrounds layer 16, the substrate comprising between about 20% and about 40% ultra-high weight molecular polyethylene, between about 40% and about 60% phase change material and between about 10% and 20% polyester; and the second material comprises 100% polyester. In one embodiment, in accordance with the principles of the present disclosure, layer 12 and layer 20 form a substrate that surrounds layer 16, the substrate comprising 33% ultra-high weight molecular polyethylene, 50% phase change material and 17% polyester; and the second material comprises 100% polyester.

In one embodiment, in accordance with the principles of the present disclosure, the first material comprises ultra-high weight molecular polyethylene and a phase change material; the second material comprises polyester, viscose and a second phase change material; and layer 20 comprises polyester. In one embodiment, in accordance with the principles of the present disclosure, the viscose is a yarn that has the second phase change material embedded within the viscose yarn. In some embodiments, the second phase change material may include a plurality of fibers that are embedded within fibers of the viscose to form yarn 18, similar to the manner in which the fibers of the phase change material are embedded into the fibers of the ultra-high weight molecular polyethylene, as discussed above and shown in FIGS. 4 and 5. In some embodiments, the fibers of the second phase change material and the fibers of viscose may be twisted and/or helically wound with one another to form yarn 18 such that the fibers of the second phase change material and the fibers of viscose form an outer surface of yarn 18. In one embodiment, in accordance with the principles of the present disclosure, the viscose is a yarn that is coated with the second phase change material. In some embodiments, the second phase change material includes molecules that are embedded on the viscose during a melt spun process wherein the phase change material is mixed into a viscose polymer solution. The solution solidifies by cooling after being extruded with the phase change material form a spinneret. In some embodiments, the coating that includes the second phase change material completely coats yarn 18. In some embodiments, the coating that includes the second phase change material coats only a portion of yarn 18. In some embodiments, the second phase change material includes microcapsules that are permanently fixed within yarn 18 by, for example, incorporating the microcapsules into the wet spinning procedure for polymer manufacturing. In some embodiments, yarn 18 includes hollow fibers with the second phase change material inside the hollow fibers. In one embodiment, in accordance with the principles of the present disclosure, yarn 14 of layer 12 is made from the ultra-high weight molecular polyethylene and the phase change material is embedded within yarn 14 of the layer 12. As shown in in FIGS. 4 and 5, the phase change material may include a plurality of fibers that are embedded within fibers of ultra-high weight molecular polyethylene to form yarn 14. In some embodiments, the fibers of the phase change material and the fibers of ultra-high weight molecular polyethylene may be twisted and/or helically wound with one another to form yarn 14 such that the fibers of the phase change material and the fibers of ultra-high weight molecular polyethylene form an outer surface of yarn 14. In one embodiment, in accordance with the principles of the present disclosure, yarn 14 of layer 12 is made from the ultra-high weight molecular polyethylene and yarn 14 of layer 12 is coated with the phase change material. In some embodiments, the coating that includes the phase change material completely coats yarn 14. In some embodiments, the coating that includes the phase change material coats only a portion of yarn 14 that defines inner surface 12*a* of layer 12. In some embodiments, the phase change material includes microcapsules that are permanently fixed within yarn 14 by, for example, incorporating the microcapsules into the wet spinning procedure for polymer manufacturing. In some embodiments, yarn 14 includes hollow fibers with the phase change material inside the hollow fibers. It is envisioned that yarn 14 can be soaked with a phase change material and/or can be infused with a phase change material. In one embodiment, in accordance with the principles of the present disclosure, layer 12 and layer 20 form a substrate that surrounds layer 16, the substrate comprising between about 20% and about 40% ultra-high weight molecular polyethylene, between about 40% and about 60% of the phase change material and between about 10% and 20% polyester; and the second material comprises between about 40% and about 60% of the viscose and the second phase change material and between about 40% and about 60% polyester. In one embodiment, in accordance with the principles of the present disclosure, layer 12 and layer 20 form a substrate that surrounds layer 16, the substrate comprising 33% ultra-high weight molecular polyethylene, 50% of the phase change material and 17% polyester; and the second material comprises 50% of the viscose and the second phase change material and 50% polyester.

In one embodiment, in accordance with the principles of the present disclosure, the first material comprises ultra-high weight molecular polyethylene and a phase change material; the second material comprises polyester, moisture wicking polyester, viscose and a second phase change material; and layer 20 comprises polyester. In one embodiment, in accordance with the principles of the present disclosure, the viscose is a yarn that has the second phase change material embedded within the viscose yarn. In some embodiments, the second phase change material may include a plurality of fibers that are embedded within fibers of the viscose to form yarn 18, similar to the manner in which the fibers of the phase change material are embedded into the fibers of the ultra-high weight molecular polyethylene, as discussed above and shown in FIGS. 4 and 5. In some embodiments, the fibers of the second phase change material and the fibers of viscose may be twisted and/or helically wound with one another to form yarn 18 such that the fibers of the second phase change material and the fibers of viscose form an outer surface of yarn 18. In one embodiment, in accordance with the principles of the present disclosure, the viscose is a yarn that is coated with the second phase change material. In some embodiments, the coating that includes the second phase change material completely coats yarn 18. In some embodiments, the coating that includes the second phase change material coats only a portion of yarn 18. In some embodiments, the second phase change material includes microcapsules that are permanently fixed within yarn 18 by, for example, incorporating the microcapsules into the wet spinning procedure for polymer manufacturing. In some embodiments, yarn 18 includes hollow fibers with the second phase change material inside the hollow fibers. In one embodiment, in accordance with the principles of the present disclosure, yarn 14 of layer 12 is made from the ultra-high weight molecular polyethylene and the phase change material is embedded within yarn 14 of layer 12. As shown in in FIGS. 4 and 5, the phase change material may include a plurality of fibers that are embedded within fibers of ultra-high weight molecular polyethylene to form yarn 14. In some embodiments, the fibers of the phase change material and the fibers of ultra-high weight molecular polyethylene may be twisted and/or helically wound with one another to form yarn 14 such that the fibers of the phase change material and the fibers of ultra-high weight molecular polyethylene form an outer surface of yarn 14. In one embodiment, in accordance with the principles of the present disclosure, the yarn of the first layer is made from the ultra-high weight molecular polyethylene and the yarn of the first layer is coated with the phase change material. In some embodiments, the coating that includes the phase change material completely coats yarn 14. In some embodiments, the coating that includes the phase change material coats only a portion of yarn 14 that defines inner surface 12*a* of layer 12. In some embodiments, the phase change material includes microcapsules that are permanently fixed within yarn 14 by, for example, incorporating the microcapsules into the wet spinning procedure for polymer manufacturing. In some embodiments, yarn 14 includes hollow fibers with the phase change material inside the hollow fibers. It is envisioned that yarn 14 and/or yarn 18 can be soaked with a phase change material and/or can be infused with a phase change material. In one embodiment, in accordance with the principles of the present disclosure, layer 12 and layer 20 form a substrate that surrounds layer 16, the substrate comprising between about 20% and about 40% ultra-high weight molecular polyethylene, between about 40% and about 60% of the phase change material and between about 10% and 20% polyester; and the second material comprises between about 40% and about 60% of the viscose and the second phase change material, between about 1% and about 15% of the moisture wicking polyester, and between about 35% and about 50% polyester. In one embodiment, in accordance with the principles of the present disclosure, layer 12 and layer 20 form a substrate that surrounds layer 16, the substrate comprising 33% ultra-high weight molecular polyethylene, 50% of the phase change material and 17% polyester; and the second material comprises 50% of the viscose and the second phase change material, 7% of the moisture wicking polyester, and 43% polyester.

Figure 6:
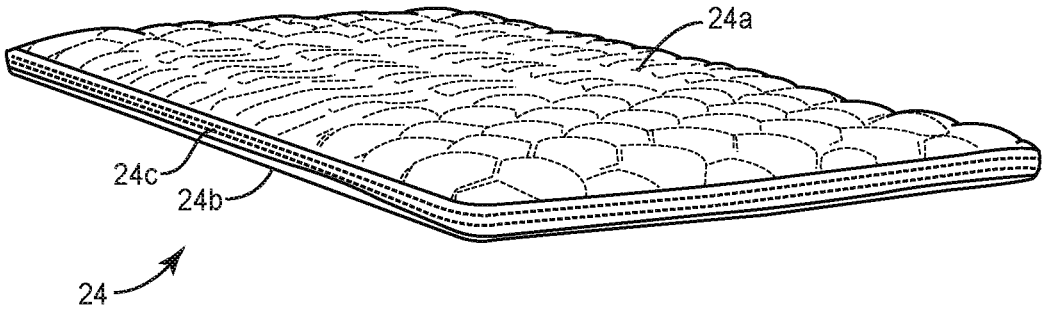
FIG. 6 is a perspective view of a mattress topper, wherein at least one component of the mattress topper comprises the fabric shown in FIG. 1.

In some embodiments, fabric 10 may be used to form all or part of various articles of bedding. For example, in one embodiment, fabric 10 is used to form all or part of a mattress topper 24. In one embodiment, shown in FIG. 6, mattress topper 24 includes opposing first and second panels 24*a*, 24*b* and a gusset 24*c* which perimetrically bounds, and joins, first and second panels 24*a*, 24*b*. In some embodiments, at least one of panels 24*a*, 24*b* are made from fabric and gusset 24*c* is formed of an open cell construction. In some embodiments, panel 24*a*, panel 24*b* and/or gusset 24*c* is/are made from fabric 10. First and second panels 24*a*, 24*b* are sized and shaped to cover all or a portion of a mattress. Gusset 24*c* has a total length that is equal to the length of peripheries of first and second panels 24*a*, 24*b*. Gusset 24*c* extends continuously about the entire periphery of each of first and second panels 24*a*, 24*b*. Inner surfaces of panel 24*a*, panel 24*b* and gusset 24*c* define a cavity. In some embodiments, a fill material may be positioned within the cavity. Gusset 24*c* preferably is generally flat. In addition, it is preferred that gusset 24*c* have sufficient width to separate first panel 24*a* from second panel 24*b* so as to define an air flow channel therethrough. This allows for an open cell construction band to be defined about the mattress topper 24 between first and second panels 24*a*, 24*b*. With pressure and/or heat applied to one or both of first and second panels 24*a*, 24*b*, gusset 24*c* provides venting therethrough of the interior of mattress topper 24. The venting may enhance the comfort of a user. With first and second panels 24*a*, 24*b* preferably defining each a generally rectangular footprint common with gusset 24*c*, gusset 24*c* is provided as four contiguous portions, including two longer longitudinal portions joined by two shorter end portions. It is envisioned that the fill material disposed within the cavity defined by panel 24*a*, panel 24*b* and gusset 24*c* may function with first and second panels 24*a*, 24*b* and/or gusset 24*c* to provide breathability to mattress topper 24 to allow air to move in and out of mattress topper 24. For example, air can leave mattress topper 24 through gusset 24*c* when a user's body is positioned on panel 24*a* or panel 24*b*. Air can enter mattress topper 24 through gusset 24*c* when the user's body is removed from panel 24*a* or panel 24*b*. It is further envisioned that air can move in and out of mattress topper 24 as the user's body changes pressure on mattress topper 24. In some embodiments, panels 24*a*, 24*b* and/or gusset 24*c* can be made of fabric 10 wherein layer 12 comprises polyethylene. Layer 16 comprises a phase change material, such as, for example, a yarn that is made of a phase change material and/or a yarn that is coated, soaked and/or infused with a phase change material. Layer 20 comprises polyethylene. In some embodiments, a membrane may be positioned on an outer surface of layer 20.

Figure 7:
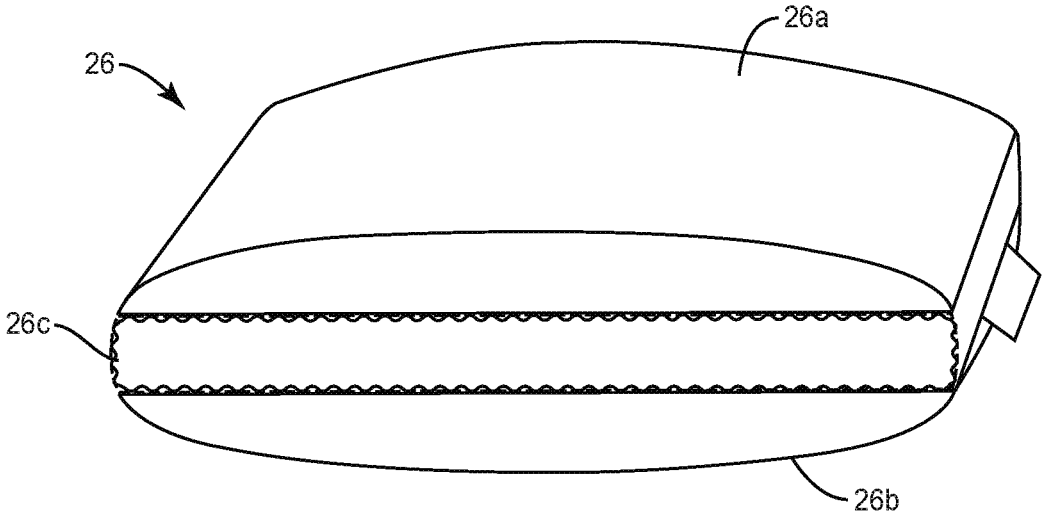
FIG. 7 is a perspective view of a pillow, wherein at least one component of the pillow comprises the fabric shown in FIG. 1.

In one embodiment, shown in FIG. 7, fabric 10 is used to form all or part of a pillow 26. In one embodiment, pillow 26 includes opposing first and second panels 26*a*, 26*b* and a gusset 26*c* which perimetrically bounds, and joins, first and second panels 26*a*, 26*b*. In some embodiments, at least one of panels 26*a*, 26*b* are made from fabric and gusset 26*c* is formed of an open cell construction. In some embodiments, panel 26*a*, panel 26*b* and/or gusset 26*c* is/are made from fabric 10. First and second panels 26*a*, 26*b* are sized and shaped to support a user's head. Gusset 26*c* has a total length that is equal to the length of peripheries of first and second panels 26*a*, 26*b*. Gusset 26*c* extends continuously about the entire periphery of each of first and second panels 26*a*, 26*b*. Inner surfaces of panel 26*a*, panel 26*b* and gusset 26*c* define a cavity. In some embodiments, a fill material may be positioned within the cavity. Gusset 26*c* preferably is generally flat. In addition, it is preferred that gusset 26*c* have sufficient width to separate first panel 26*a* from second panel 26*b* so as to define an air flow channel therethrough. This allows for an open cell construction band to be defined about pillow 26 between first and second panels 26*a*, 26*b*. With pressure and/or heat applied to one or both of first and second panels 26*a*, 26*b*, gusset 26*c* provides venting therethrough of the interior of pillow 26. The venting may enhance the comfort of a user. With first and second panels 26*a*, 26*b* preferably defining each a generally rectangular footprint common with gusset 26*c*, gusset 26*c* is provided as four contiguous portions, including two longer longitudinal portions joined by two shorter end portions. It is envisioned that the fill material disposed within the cavity defined by panel 26*a*, panel 26*b* and gusset 26*c* may function with first and second panels 26*a*, 26*b* and/or gusset 26*c* to provide breathability to pillow 26 to allow air to move in and out of pillow 26. For example, air can leave pillow 26 through gusset 26*c* when a user's head is positioned on panel 26*a* or panel 26*b*. Air can enter pillow 26 through gusset 26*c* when the user's body is removed from panel 26*a* or panel 26*b*. It is further envisioned that air can move in and out of pillow 26 as the user's head changes pressure on pillow 26.

In some embodiments, panel 26*a*, panel 26*b* and/or gusset 26*c* can be made of fabric 10 wherein layer 12 comprises vertex and/or polyethylene. Layer 16 comprises a phase change material, such as, for example, a fiber that is made of a phase change material and/or a fiber that is coated, soaked and/or infused with a phase change material. Layer 20 comprises polyester. In some embodiments, a membrane may be positioned on an outer surface of layer 20.

In some embodiments, panel 26*a*, panel 26*b* and/or gusset 26*c* can be made of fabric 10 wherein layer 12 comprises polyethylene terephthalate and/or another material that will provide a cool touch. Layer 16 comprises a phase change material, such as, for example, a fiber that is made of a phase change material and/or a fiber that is coated, soaked and/or infused with a phase change material. Layer 20 comprises polyethylene terephthalate and/or another material that will provide a cool touch.

In some embodiments, panel 26*a*, panel 26*b* and/or gusset 26*c* can be made of fabric 10 wherein layer 12 comprises polyethylene terephthalate and/or another material that is a highly dense, solid and/or straight yarn. Layer 16 comprises a phase change material, such as, for example, a yarn that is made of a phase change material and/or a yarn that is coated, soaked and/or infused with a phase change material. Layer 20 comprises polyethylene terephthalate and/or another material that is a highly dense, solid and/or straight yarn.

In some embodiments, panel 26*a*, panel 26*b* and/or gusset 26*c* can be made of fabric 10 wherein layer 12 comprises polyethylene. Layer 16 comprises a phase change material, such as, for example, a yarn that is made of a phase change material and/or a yarn that is coated, soaked and/or infused with a phase change material. Layer 20 comprises polyethylene.

Figure 8:
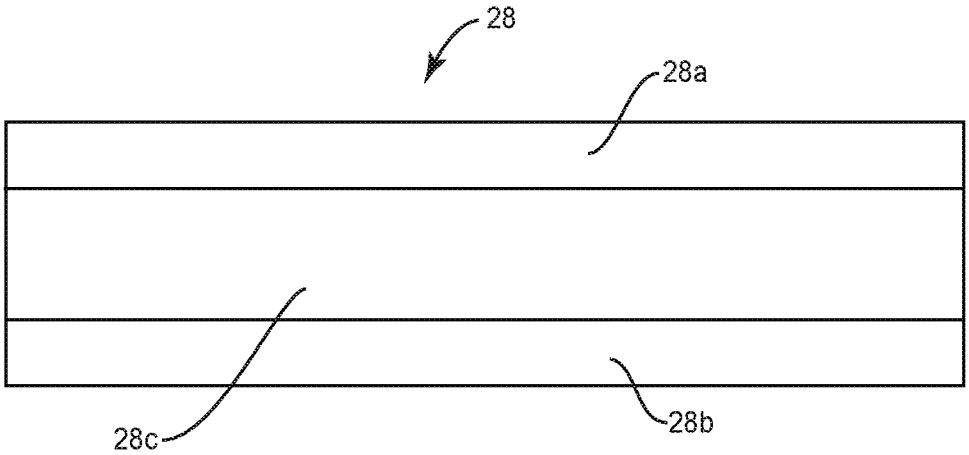
FIG. 8 is a schematic, cross sectional view of a mattress, wherein at least one component of the mattress comprises the fabric shown in FIG. 1.

In one embodiment, shown in FIG. 8, fabric 10 is used to form all or part of a mattress 28. In one embodiment, mattress 28 includes opposite first and second layers 28*a*, 28*b* and a core 28*c* positioned between layers 28*a*, 28*b*. In some embodiments, core 28*c* may be made from memory foam or another type of foam or gel. In some embodiments, core 28*c* may include a plurality of springs. Layer 28*a* and/or layer 28*b* may be made from fabric 10.

In some embodiments, layer 28*a* and/or layer 28*b* can be made of fabric 10 wherein layer 12 comprises vertex and/or polyethylene. Layer 16 comprises a phase change material, such as, for example, a fiber that is made of a phase change material and/or a fiber that is coated, soaked and/or infused with a phase change material. Layer 20 comprises polyester.

In some embodiments, a membrane may be positioned on an outer surface of layer 20. In some embodiments, layer 28*a* and/or layer 28*b* can be made of fabric 10 wherein layer 12 comprises polyethylene terephthalate and/or another material that will provide a cool touch. Layer 16 comprises a phase change material, such as, for example, a fiber that is made of a phase change material and/or a fiber that is coated, soaked and/or infused with a phase change material. Layer 20 comprises polyethylene terephthalate and/or another material that will provide a cool touch.

In some embodiments, layer 28*a* and/or layer 28*b* can be made of fabric 10 wherein layer 12 comprises polyethylene terephthalate and/or another material that is a highly dense, solid and/or straight yarn. Layer 16 comprises a phase change material, such as, for example, a yarn that is made of a phase change material and/or a yarn that is coated, soaked and/or infused with a phase change material. Layer 20 comprises polyethylene terephthalate and/or another material that is a highly dense, solid and/or straight yarn.

Figure 9:
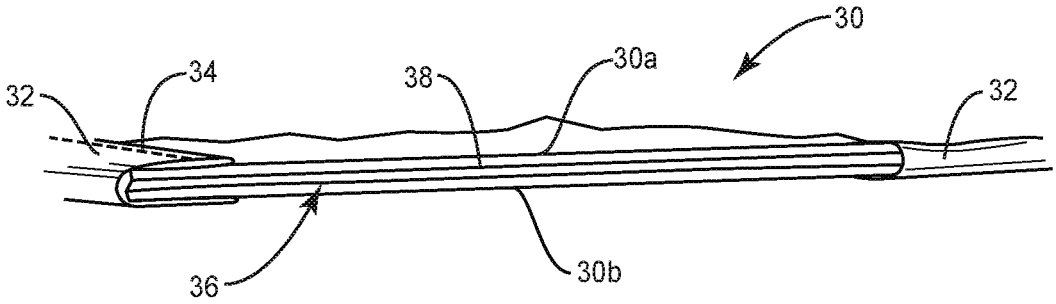
FIG. 9 is a cross sectional view of a blanket, wherein at least one component of the blanket comprises the fabric shown in FIG. 1.

In one embodiment, shown in FIG. 9, fabric 10 is used to form all or part of a blanket 30. In one embodiment, blanket 30 includes a panel 30*a* and an opposite panel 30*b*. Blanket 30 may include binding 32 that covers panels 30*a*, 30*b* to join panels 30*a*, 30*b* together at the perimeters of panels 30*a*, 30*b*. In some embodiments, binding 32 joins panels 30*a*, 30*b* via stitching 34 that extends through the outer surface of binding 32 a first time, through opposite inner and outer surfaces of panel 30*a*, through opposite inner and outer surfaces of panel 30*b* and then through the outer surface of binding 32 a second time, as shown in FIG. 9. In some embodiments, binding 32 is rib knit jersey binding, or ripstop nylon binding or other materials or combination thereof. In some embodiments, blanket 30 includes single unit, such as, for example, a single unit that is made up of panel 30*a* and panel 30*b*, wherein panels 30*a*, 30*b* are joined by binding 32 and panels 30*a*, 30*b* and binding 32 are bound together by stitching 34. As such, the single unit cannot be taken apart without removing stitching 34. In some embodiments, panel 30*a* and/or panel 30*b* is made from fabric 10. In some embodiments, binding 32 comprises a material that is different that the material panel 30*a* and/or panel 30*b* is made from. In some embodiments, binding 32 comprises a material that is the same as the material panel 30*a* and/or panel 30*b* is made from. In some embodiments, binding 32 is a decorative trim, such as, for example, a ruffle. In some embodiment, stitching 34 is a single needle closure. In some embodiments, stitching 34 is a single needle closure around all edges of panel 30*a* and/or panel 30*b*.

Inner surfaces of panels 30*a*, 30*b* define a cavity 36 of blanket 30 therebetween, as shown in FIG. 9. In some embodiments, cavity 36 is configured for disposal of a fill material 38. In some embodiments, fill material 38 may be any material that provides insulation to keep a sleeper warm or cool. In some embodiments, fill material 38 is configured to trap heat from the sleeper's body between blanket 30 and a sleep surface. In some embodiments, fill material 38 comprises a single layer of material. In some embodiments, fill material 38 comprises multiple layers of material. In some embodiments, fill material 38 comprises a compliant material. In some embodiments, fill material 38 comprises a non-compliant material. In some embodiments, fill material 38 comprises polyester fiber, other man-made fiber or natural fiber, such as but not limited to wool, kapok, latex, foam, memory foam, feathers, gel, memory foam, and/or combinations or blends of the same. In some embodiments, fill material 38 comprises 50% Cluster (e.g., 3 D*32 mm w/silicon) and 50% Micro fiber (e.g., 2.5 D*32 mm w/silicon. In some embodiments, fill material 38 comprises a single piece of foam. In some embodiments, fill material 38 is a material that makes blanket 30 a cooling blanket. In some embodiments, blanket 30 does not include any fill material between panels 30*a*, 30*b*. That is, blanket 30 is free of any fill material.

It is envisioned that fabric 10 may also be used to make other articles of beddings, such as, for example, bed sheets, pillow cases, etc. It is envisioned that fabric 10 may also be used to make products that are not related to bedding, such as, for example, clothing.

It will be understood that various modifications may be made to the embodiments disclosed herein. For example, features of any one embodiment can be combined with features of any other embodiment. Therefore, the above description should not be construed as limiting, but merely as exemplification of the various embodiments. Those skilled in the art will envision other modifications within the scope and spirit of the claims appended hereto.

What is claimed is:

1. A three-layer circular knitted jacquard fabric comprising:

a first layer comprising a yarn made from a first material;

a second layer comprising a yarn made from a second material; and a third layer comprising a yarn made from a third material, at least one of the materials comprising ultra-high weight molecular polyethylene, wherein the second layer is positioned between the first layer and the third layer such that the second layer provides loft between the first layer and the third layer, wherein the first material comprises ultra-high weight molecular polyethylene and a phase change material, wherein the second material comprises polyester, viscose and a second phase change material, and wherein the third material comprises polyester.

2. A fabric as recited in claim 1, wherein the first layer and the third layer form a substrate that surrounds the second layer.

3. A fabric as recited in claim 1, wherein the third material is 100% polyester.

4. A fabric as recited in claim 1, wherein the first layer and the third layer form a substrate that surrounds the second layer, the substrate comprising a first amount of ultra-high weight molecular polyethylene and a second amount of polyester based on a total volume of the substrate, the second amount being greater than the first amount.

5. A fabric as recited in claim 1, wherein the first layer and the third layer form a substrate that surrounds the second layer, the substrate comprising between about 10% and about 50% ultra-high weight molecular polyethylene and between about 50% and 90% polyester based on a total volume of the substrate.

6. A fabric as recited in claim 1, wherein the viscose is a yarn that has the second phase change material embedded within the viscose yarn.

7. A fabric as recited in claim 1, wherein the viscose is a yarn that is coated with the second phase change material.

8. A fabric as recited in claim 1, wherein the yarn of the first layer is made from the ultra-high weight molecular polyethylene and the yarn of the first layer is coated with the phase change material.

9. A fabric as recited in claim 1, wherein:

the first layer and the third layer form a substrate that surrounds the second layer, the substrate comprising between about 20% and about 40% ultra-high weight molecular polyethylene, between about 40% and about 60% of the phase change material and between about 10% and 20% polyester based on a total weight of the substrate; and the second material comprises between about 40% and about 60% of the viscose and the second phase change material and between about 40% and about 60% polyester based on a total weight of the second material.

10. A fabric as recited in claim 1, wherein:

the first layer and the third layer form a substrate that surrounds the second layer, the substrate comprising 33% ultra-high weight molecular polyethylene, 50% of the phase change material and 17% polyester based on a total volume of the substrate; and the second material comprises 50% of the viscose and the second phase change material and 50% polyester based on a total volume of the second material.

11. A fabric as recited in claim 1, wherein the second material further comprises, moisture wicking polyester.

12. A fabric as recited in claim 11, wherein the viscose is a yarn that has the second phase change material embedded within the viscose yarn.

13. A fabric as recited in claim 11, wherein the viscose is a yarn that is coated with the second phase change material.

14. A fabric as recited in claim 11, wherein the phase change material is derived from petroleum or salt hydrates.

15. A fabric as recited in claim 11, wherein the second phase change material is derived from petroleum or salt hydrates.

16. A fabric as recited in claim 11, wherein the yarn of the first layer is made from the ultra-high weight molecular polyethylene and the phase change material is embedded within the yarn of the first layer.

17. A fabric as recited in claim 11, wherein:

the first layer and the third layer form a substrate that surrounds the second layer, the substrate comprising 33% ultra-high weight molecular polyethylene, 50% of the phase change material and 17% polyester based on a total volume of the substrate; and the second material comprises 50% of the viscose and the second phase change material, 7% of the moisture wicking polyester, and 43% polyester based on a total volume of the second material.

18. An article of bedding comprising:

first and second panels, inner surfaces of the panels defining a cavity; and a fill material disposed in the cavity, wherein at least one of the panels is made from the fabric recited in claim 1, the article of bedding being selected from the group consisting of mattress toppers, mattresses, pillows, sheets, and blankets.

19. A three-layer circular knitted jacquard fabric comprising:

a first layer comprising a yarn made from a first material;

a second layer comprising a yarn made from a second material; and a third layer comprising a yarn made from a third material, at least one of the materials comprising ultra-high weight molecular polyethylene, wherein the second layer is positioned between the first layer and the third layer such that the second layer provides loft between the first layer and the third layer, wherein the first material comprises ultra-high weight molecular polyethylene, wherein the second material comprises polyester and moisture wicking polyester, and wherein the third material comprises polyester.

20. A fabric as recited in claim 19, wherein at least one of the materials comprises a phase change material.

21. A fabric as recited in claim 19, wherein at least one of the second and third materials comprises a phase change material.

22. An article of bedding comprising:

first and second panels, inner surfaces of the panels defining a cavity; and a fill material disposed in the cavity, wherein at least one of the panels is made from a fabric three-layer circular knitted jacquard fabric comprising:

a first layer comprising a yarn made from a first material;

a second layer comprising a yarn made from a second material; and a third layer comprising a yarn made from a third material, at least one of the materials comprising ultra-high weight molecular polyethylene, wherein the second layer is positioned between the first layer and the third layer such that the second layer provides loft between the first layer and the third layer, and wherein the article of bedding is selected from the group consisting of mattress toppers, mattresses, pillows, sheets, and blankets.

23. An article of bedding as recited in claim 22, wherein at least one of the materials comprises a phase change material.

24. An article of bedding as recited in claim 22, wherein at least one of the second and third materials comprises a phase change material.

* * * * *